US005269220A

United States Patent [19]

Doery et al.

[11] Patent Number: 5,269,220

[45] Date of Patent: Dec. 14, 1993

[54] INK TRAY AND PLATEN DRIVE TRAIN FOR A FLAT BED POSTAGE PRINTING APPARATUS

[75] Inventors: Michael S. Doery, Monroe, Conn.; Arnold T. Eventoff, Pleasantville, N.Y.; James A. Salomon, Cheshire, Conn.

[73] Assignee: Pitney Bowes Inc., Stamford, Conn.

[21] Appl. No.: 24,059

[22] Filed: Mar. 1, 1993

[51] Int. Cl.[5] ..... B41L 47/46

[52] U.S. Cl. ..... 101/91; 101/333; 101/292; 101/318; 101/324

[58] Field of Search ..... 101/45, 71, 91, 333, 101/292, 318, 319, 324, 325

[56] References Cited

U.S. PATENT DOCUMENTS

| | | | |
|---|---|---|---|
| 3,722,405 | 3/1973 | Maltoney et al. | 101/45 |
| 3,863,567 | 2/1975 | Hastings | 101/354 |
| 3,869,885 | 3/1975 | Uthenwoldt | 70/315 |
| 3,869,924 | 3/1975 | Beezer | 74/24 |
| 3,918,313 | 11/1975 | Montagnino | 74/393 |
| 3,974,705 | 8/1976 | Wittkamp | 74/53 |
| 4,489,651 | 12/1984 | De Luca et al. | 101/93.36 |
| 4,492,158 | 1/1985 | Clark | 101/93.05 |
| 4,492,160 | 1/1985 | Clark et al. | 101/71 |
| 4,493,252 | 1/1985 | Clark | 101/71 |
| 4,519,048 | 5/1985 | Abellana et al. | 364/900 |
| 4,637,051 | 1/1987 | Clark | 101/71 |
| 4,779,531 | 10/1988 | Ueno et al. | 101/163 |
| 5,060,741 | 10/1991 | Abellana et al. | 177/4 |

*Primary Examiner*—Eugene H. Eickholt

*Attorney, Agent, or Firm*—Charles G. Parks, Jr.; Melvin J. Scolnick

[57] ABSTRACT

The drive system for a mailing flat bed postage printing apparatus includes a postage meter cartridge having an indicia plate mounted in the base of the printing apparatus. An inking system is included for inking the indicia plate. The inking system includes a drive motor mounted to the base in driving communication with a first shaft rotatively mounted in the base. A cam is mounted to the first shaft having a cam surfaces. An ink tray is positionable by a linkage system wherein the linkage system includes cam followers in communication with the cam surface to position the ink tray in response to the rotational position of the cam. A platen is reciprocally positionable between a first and print position in the base. The cam is rotated in a first range wherein the cam surface positions the linkage system and a second range of rotation wherein the linkage system is in a dwell mode. An intermediate gear system is provided for positioning the platen between the first and print position only when the cam is rotated in the second range.

4 Claims, 15 Drawing Sheets

(CAMSHAFT ROTATION)

(CAMSHAFT ROTATION)

(CAMSHAFT ROTATION)

(TRAY X MOTION)

(TRAY X MOTION)

(TRAY X MOTION)

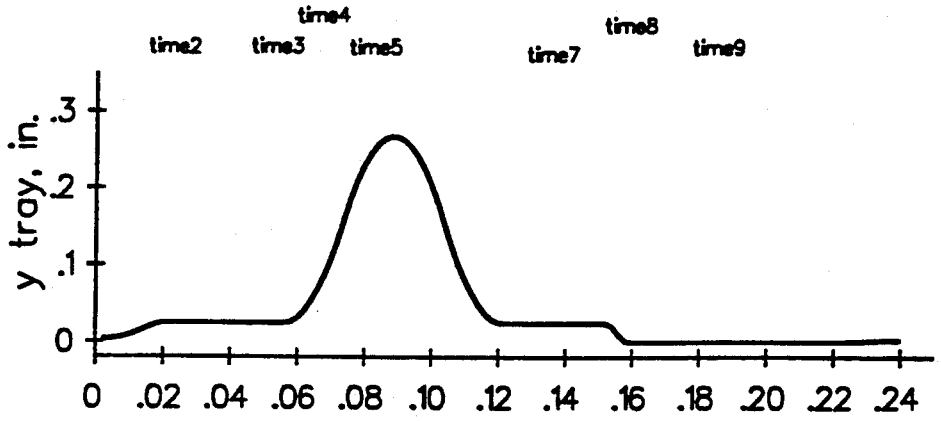
FIG. 9G
(TRAY Y MOTION)
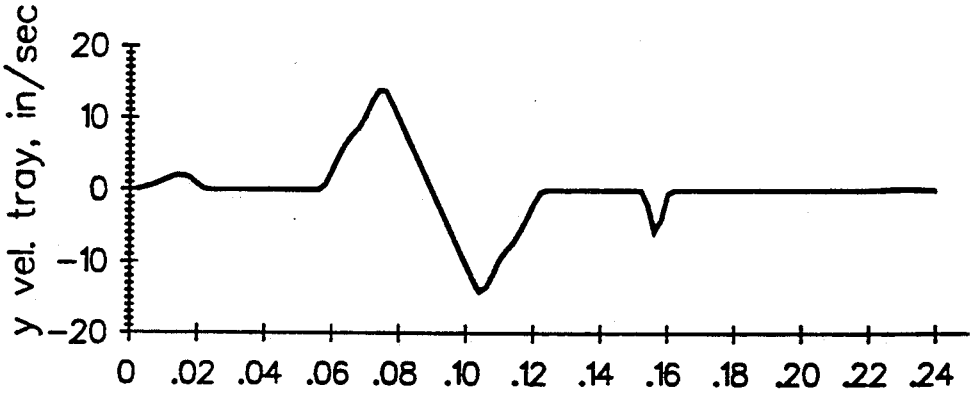
FIG. 9H
(TRAY Y MOTION)
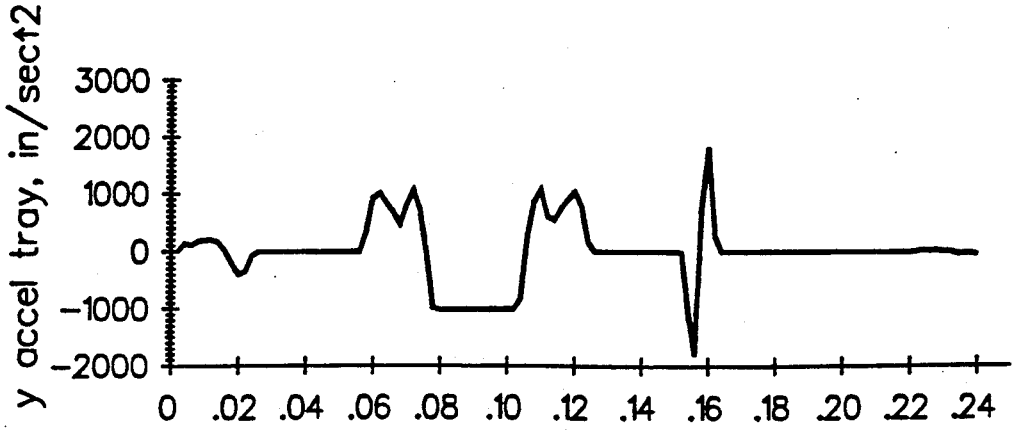
FIG. 9I (TRAY Y MOTION)

(CAM PROFILE)

(CAM PROFILE)

(ACTUATOR Y MOTION)

(ACTUATOR Y MOTION)

(ACTUATOR Y MOTION)

(SMP KINEMATICS)

INK TRAY AND PLATEN DRIVE TRAIN FOR A FLAT BED POSTAGE PRINTING APPARATUS

BACKGROUND OF THE INVENTION

The present invention relates generally to employing a single drive system to cooperatively drive a first and second system who operations are synchronized and, more particularly, an improved drive system having a single prime mover attached to a drive train which synchronously drive the inking system and platen system of a envelope printing apparatus.

A particularly applicable prior art device is disclosed in U.S. Pat. No. 4,945,831, commonly assigned and titled, "Ink Tray Drive". The system there discloses a first drive system for moving an ink pad in two directions, for example, horizontally and vertically, utilizing camming means, links and a first motor. The ink pad is moved from a home position to an inking position in which the ink pad is tamped against a printing device, and may also operate a pump for pumping ink to the ink pad, preferably by means of the same motor. It can be observed from an inspection of U.S. Pat. No. 4,945,831 that a separate motor is used to actuate the platen to complete the printing process after the ink pad has been returned to the home position and an envelope is properly positioned.

In the most preferred embodiment of the invention, the embodying system utilizes smart motors. By smart motors, it is meant that each motor carries on-board information processing capability in order to obtain precise motor response characteristic when the respective motors are under the influence of a microprocessor based motor control system. It is apparent that smart motors represent a substantial system cost and adversely effect microprocessor processing overhead for each motor, and, in a suitable system, additional hardware. All of this represents additional system cost. In addition, the addition of each motor places additional burdens on the system power supply.

SUMMARY OF THE INVENTION

It is an objective of the present invention to present a power train drive system which is utilized to drive a first and second system, characterized in that a single motor is employed.

It is a further objective of the present invention to present a drive system which is particularly suited for a mail processing system of the type disclosed in U.S. Pat. No. 4,945,831. The mail processing system is characterized in that a base includes a receptacle for receiving a meter cartridge. A vertically displaceable platen is located just below and in spaced relation to the print registration area of the meter cartridge. An envelope may be positioned between the meter registration area and the platen. Actuating the platen will cause the envelope to encounter the meter print indicia at sufficient impact pressure to effectuate printing of the indicia on the envelope. Preferably, prior to each print, the meter indicia is reinked by a retractable ink pad which occurs at the initiation of the print cycle.

A single motor is mounted in the base and drives a cam shaft. The cam shaft includes at its end a camming arrangement which upon actuation of the motor causes associated cam follower to move an ink pad assembly in the prescribed manner. Following the inking process, the ink pad being returned to the home position, continued actuation of the drive motor causes synchronous engagement of a intermediate gear with a gear drive associated with the motion of the platen. Following platen actuation, the motor is reversed to an initial position. During this time, the inking system is experiencing lost motion between the cam and cam-followers of the camming arrangement and the platen is returned to a lowered position to complete the inking cycle.

It is therefore appreciated that in the preferred embodiment the existing displacement profiles and loading of both the inking system and the platen system can be preserved employing a single motor drive system over the known two-motor drive systems. It is also apparent that in any like system having similar system requirements, the same or substantially similar system benefits are realizable.

BRIEF DESCRIPTION OF THE DRAWINGS

The invention is illustrated by way of example and: not limitation in the figures of the accompanying drawings in which like references denote the same elements, and in which:

FIGS. 9D through 9I are plots of the relative tray displacement, velocities and acceleration as a function of time.

FIGS. 10A through 10C are plots of the position of the inker tray as a function at cam angle in accordance with the present invention.

DESCRIPTION OF THE PREFERRED EMBODIMENT

Figure 1:
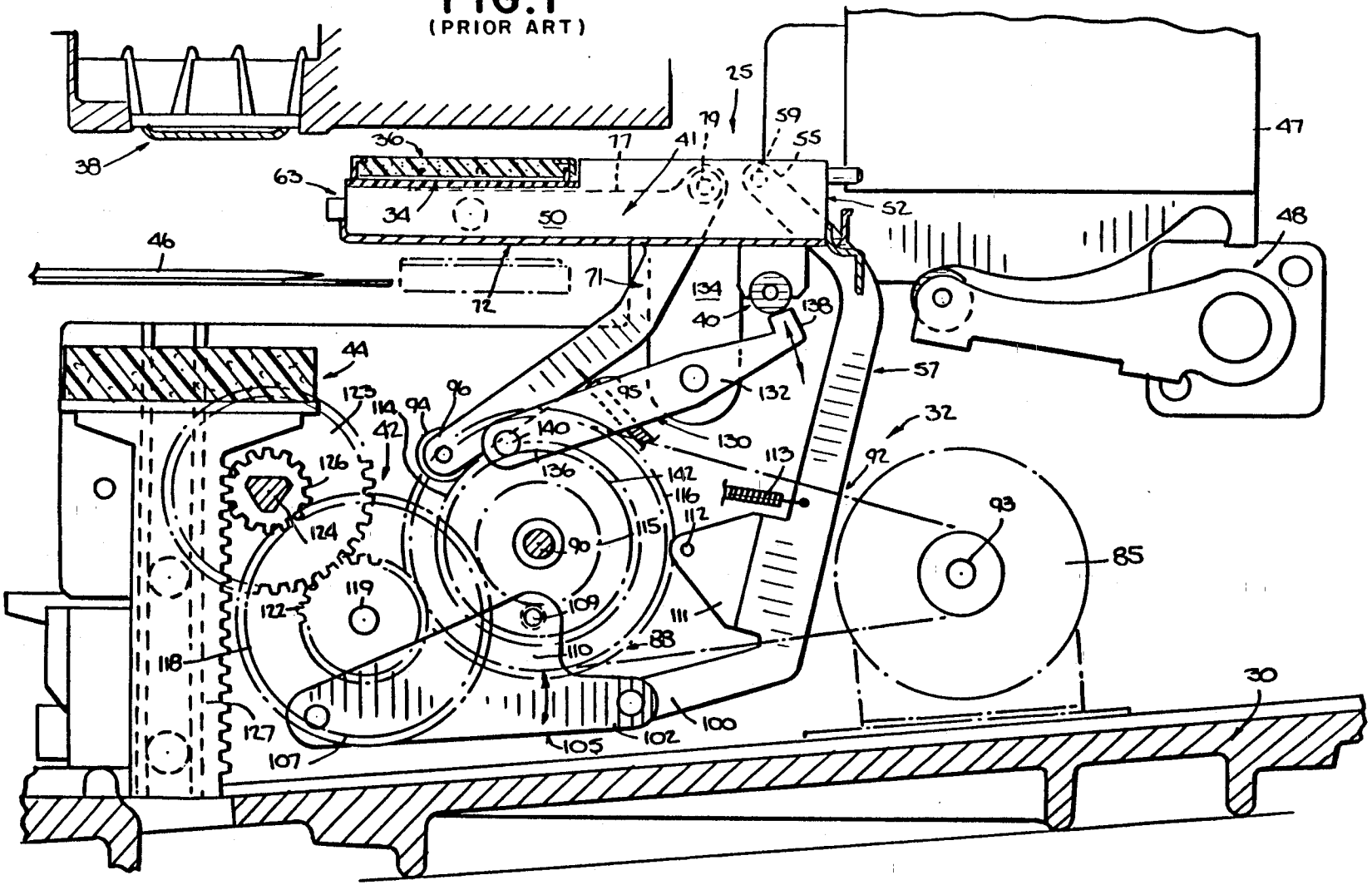
FIG. 1 (PRIOR ART)
FIG. 1 is a sectional view of the prior art drive system for the ink pad tray in its home position, and a pump for the ink pad, a printing device and a platen device in its home position.
Figure 2:
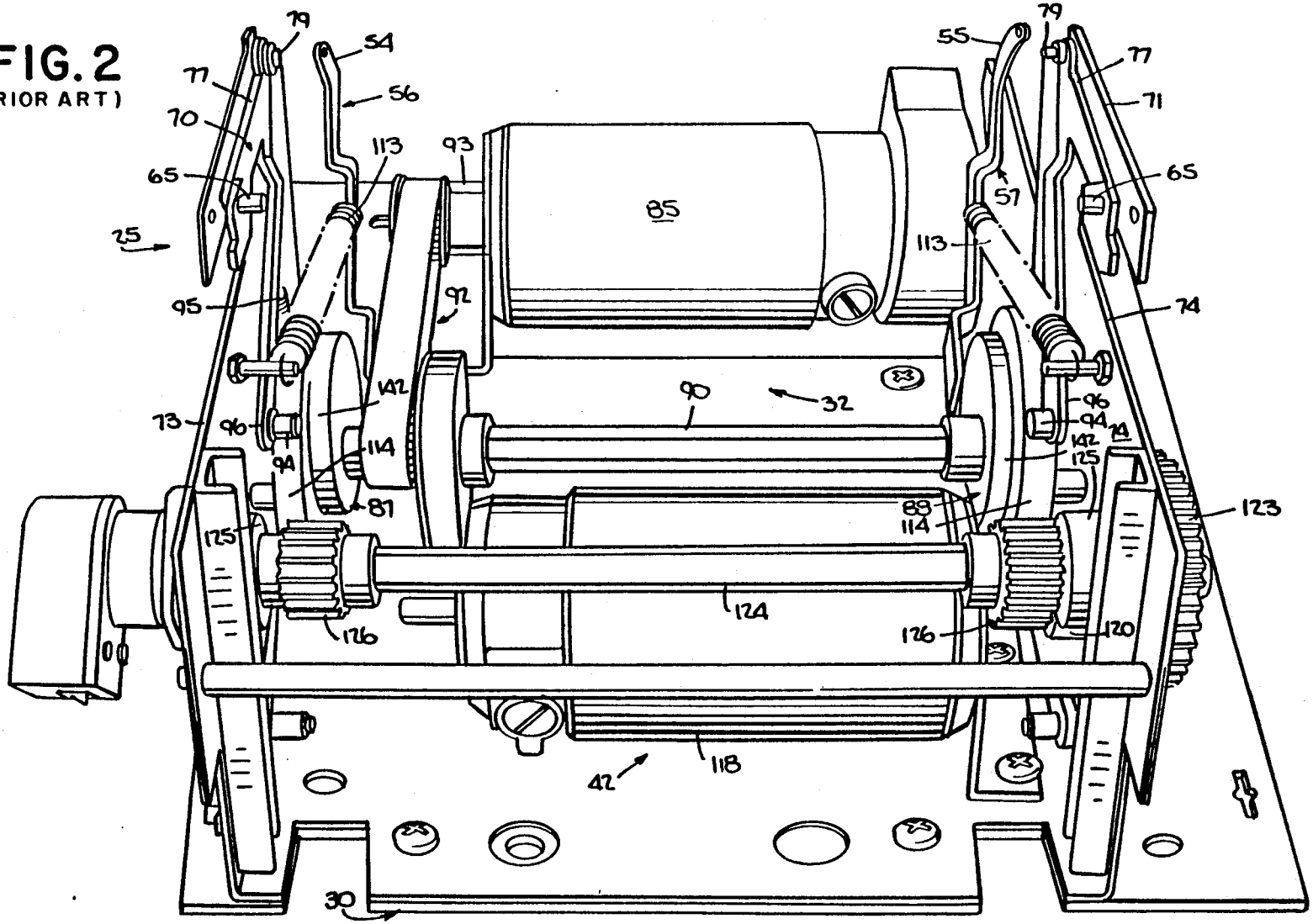
FIG. 2 (PRIOR ART)
FIG. 2 is a front perspective view of the prior art drive system depicted in FIG. 1.

Referring to FIGS. 1 and 2, the prior art system particularly described in U.S. Pat. No. 4,945,831, commonly assigned and hereby incorporated by reference. The system described in U.S. Pat. No. 4,945,831 is comprised of an inker module 25 which includes a chassis 30 which house drive 32 that (a) moves an ink pad tray 34 (FIG. 1) from a home position (FIG. 1) to an inking position (not here shown) in which an ink pad 36 (FIG. 1) is tamped against a printing device 38 (FIG. 1) to ink the printing device; and (b) actuates a pump 40 (FIG. 1) to pump ink from a reservoir 41 in ink pad tray 34 to ink pad 36. Chassis 30 also houses drive 42 which moves platen device 44 (FIG. 1) upwardly from a home position (FIG. 1) to a printing position (not here shown) in which an envelope or strip of tape 46 is pressed against printing device 38 to imprint postage indicia thereon. Printing device 38 is part of a flat-bed postage meter referenced generally by 47 (FIG. 1) which is pivotally mounted by a counterbalance mechanism 48 in a system including inker module 25.

Ink tray 34 at opposed sides 50 (FIG. 1) adjacent its rear 52 which is pivotally connected to ends 54, 55 (FIG. 1) of links 56, 57, respectively, by inwardly projecting pins 59 from links 56, 57 snap fitted in suitable receptacles of ink tray 34. The forward part 63 of ink tray 34 is supported by pins 65, (FIG. 1) inwardly projecting from respective ends of links 70, 71, respectively. That snap fit arrangement facilitates replacement of ink tray 34. A platform 72, which receives the ink tray 34 in its home position, is fixed to chassis 30 so that links 56 and 57 move relative to platform 72. Pins 65 extend into slots or cut-outs 73 in sides 50 of ink tray 34 (not here shown) so that ink tray 34 may be moved by links 56 and 57 relative to platform 72 riding on pins 65. Platform 72 is attached to opposed sides 73, 74 (FIG. 1) of chassis 38 by any suitable means such as screws so that it may be removed for ease of assembling, disassembling and servicing of drives 32 and 42. Links 70 and 71 are pivotally attached in a central region 77 thereof to platform 72 by pins 79 so that ends 67 and 48 of links 70 and 71 pivot upwardly (clockwise) relative to platform 72. Movement of links 56 and 57 to the left in FIG. 1 move ink tray 34 horizontally to the left relative to platform 72, and clockwise pivoting of links 70 and 71 moves ink tray 34 vertically upwardly.

Drive 32 first moves links 56 and 57 to the left to move ink tray 34 horizontally to the left from its rest position to a position registered with printing device 38. Drive 32 then pivots links 70 and 71 to move ink tray 34 vertically and tamp it against printing device 38 to ink it. Before drive 42 raises platen device 44 to press an envelope 46 against printing indicia 38, drive 32 moves links 70 and 71, and links 56 and 57 in reverse to the ink tray 34 to its home position.

Drive 32 includes drive motor 85, cam wheels 87, 88 fixed to cam shaft 90 journals to sides 72 and 73 of chassis 30, and pulley system 92 coupling motor shaft 93 and cam shaft 90. Links 70 and 71 have respective rollers 94 rotatably connected to respective ends 96 thereof and are supported from chassis sides 72 and 73 such that respective rollers 94 ride on cam wheels 87 and 88, respectively. Springs 95 urge link 72 and 73 towards cam wheels 87, 88, and urge rollers 94 thereof into engagement with cam wheels 87, 88. Links 56 and 57 are pivotally connected at respective ends 100 thereof to respective ends 102 of links 104 and 105, respectively. Links 105 are pivotally connected at respective ends 197 to chassis sides 73 and 74, respectively, and have respective rollers 109 rotatably connected to a respective central part 110 thereof. Links 56 and 57 have rotatably connected to a respective central part 111 (FIG. 1) thereof respective rollers 112. Springs 113 urge links 56 and 57 towards cam wheels 87, 88, and urge rollers 112 thereof into engagement with cam wheels 97, 88. Cam wheels 87 and 88 each include a cam surface 114 on which a respective roller 94 rides, a cam surface 115 on which a respective follower 109 rides, and a cam surface 116 on which a respective roller 112 rides. Links 56 and 104, and links 57 and 105 are interconnected and supported such that respective rollers ride on respective cam surfaces of cam wheels 87 and 88, respectively, as respective cam followers. The cam surfaces are contoured to move the various links upon a given rotation of cam shaft 90 to provide the motion of ink tray 34 described above, and the cam surfaces are aligned axially offset, as shown, or may be circumferentially aligned along the respective outer peripheries of cam wheels 87, 88. Cam wheels 87, 88 may be rotated through a cycle, with constant velocity or continuously with variable velocity, or cam wheels 87, 88 may be oscillated through a cycle.

The drive 42 of the prior assembly includes motor 118 having motor shaft 119, supported from sides 73, 74 of chassis 30. A gear 122 fixed to shaft 119, gear 123 meshing with and driven by gear 119, shaft 124 fixed to gear 123 and supported from chassis 30 by bearings 125, pinion gears 126 fixed to shaft 124, and racks 127 (FIG. 1) fixed to opposed sides of platen device 44 meshed with respective pinion gears 126. Actuation of motor 118 causes pinion gears 126 to rotate, engaging and elevating respective racks 127 and with the platen device 44.

Figure 3:
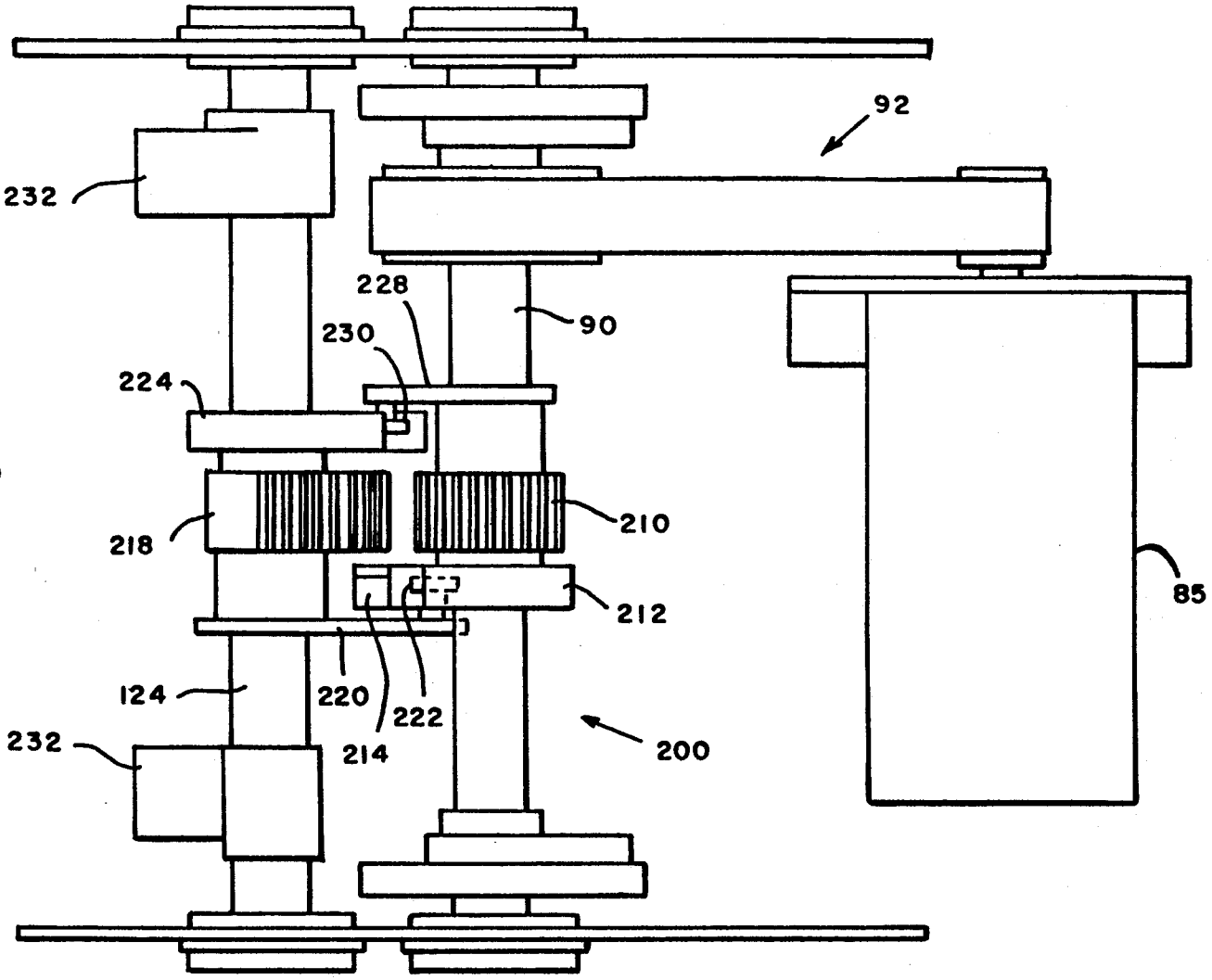
FIG. 3 is a top view of the drive system in accordance with the present invention.
Figure 4:
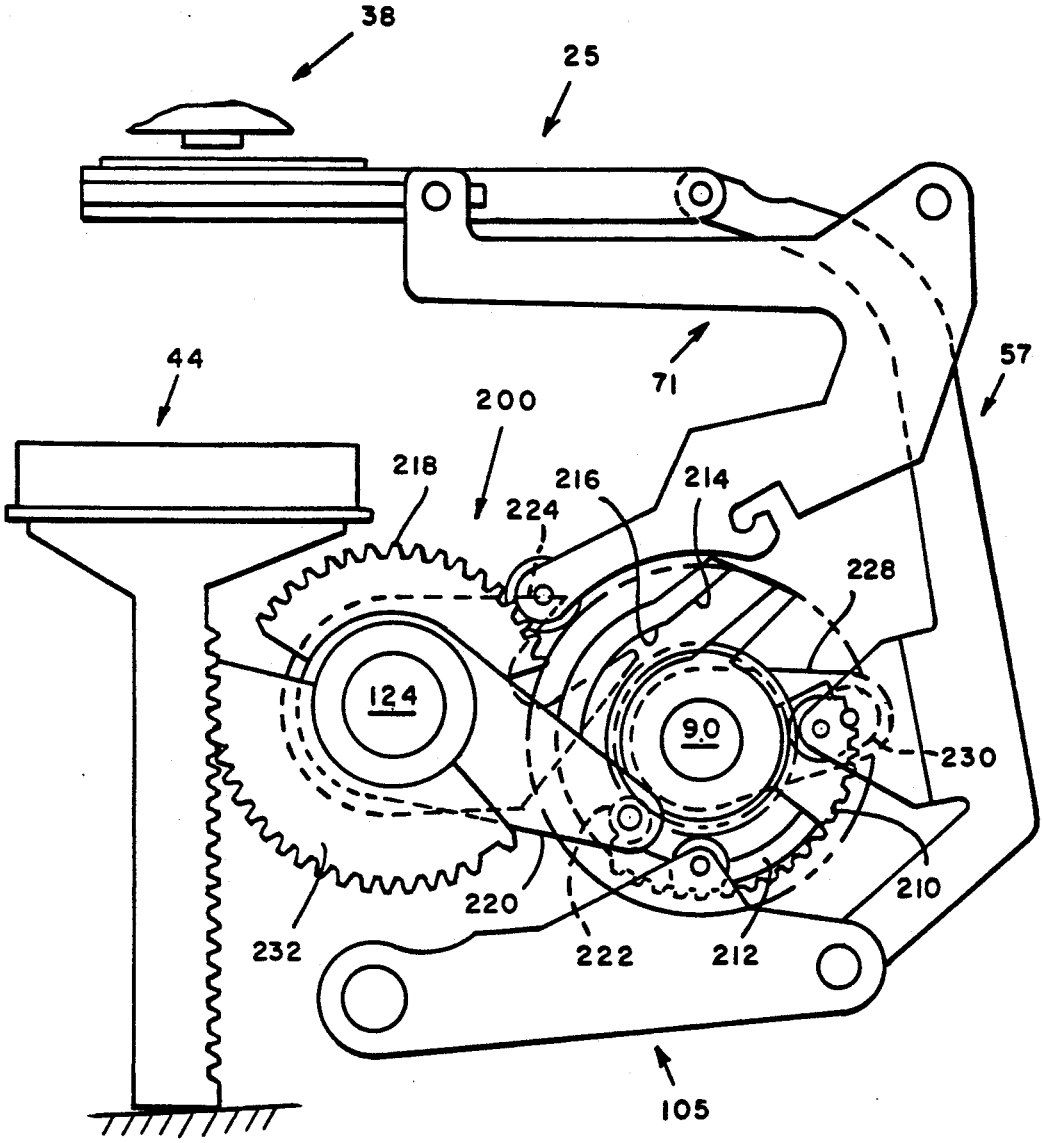
FIG. 4 is a simplified side view of a portion of the forward gear drive portion of the drive system in accordance with the present invention.
Figure 5:
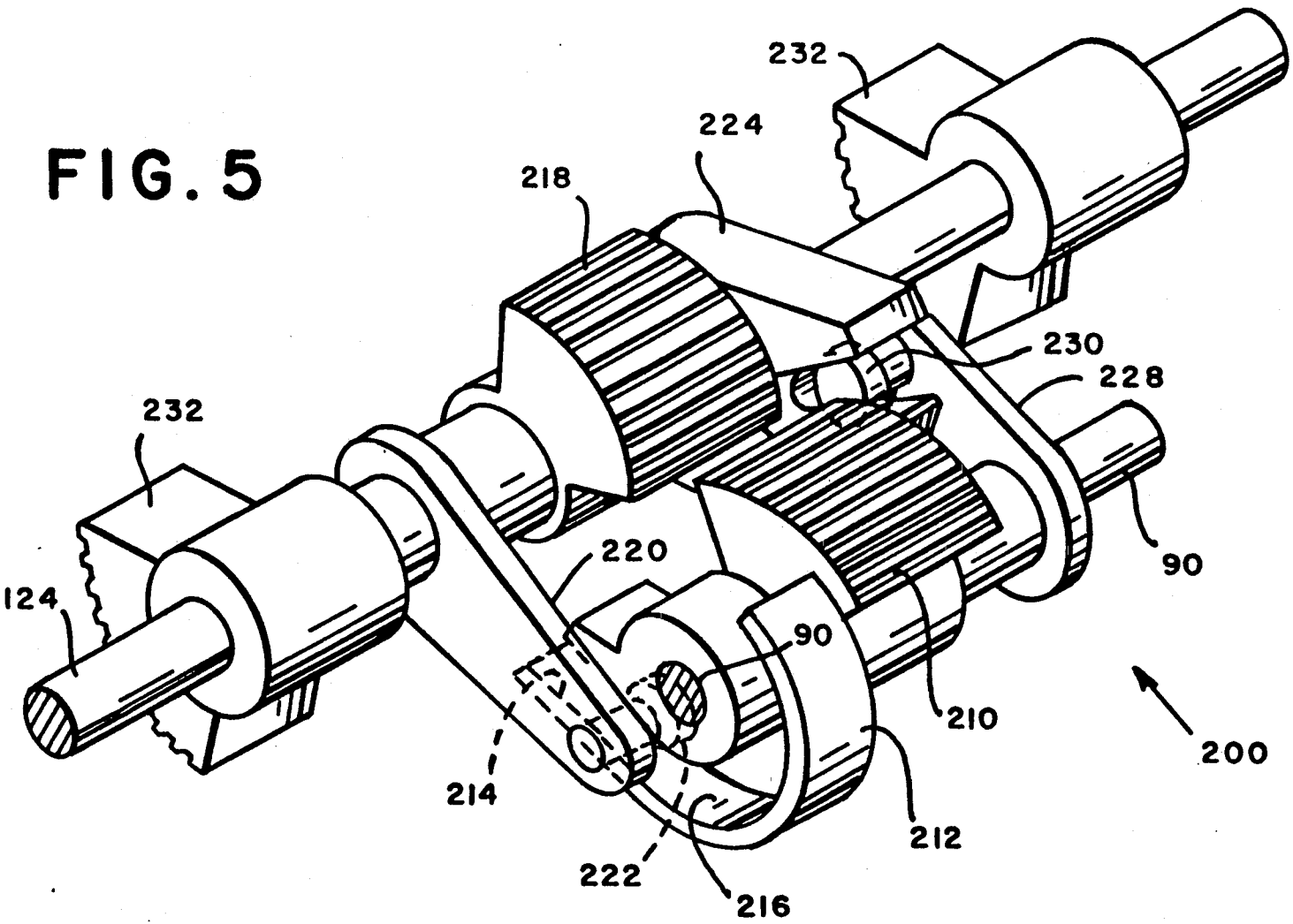
FIG. 5 is a perspective view of the forward gear drive portion of the drive system in accordance with the present invention.
Figure 6:
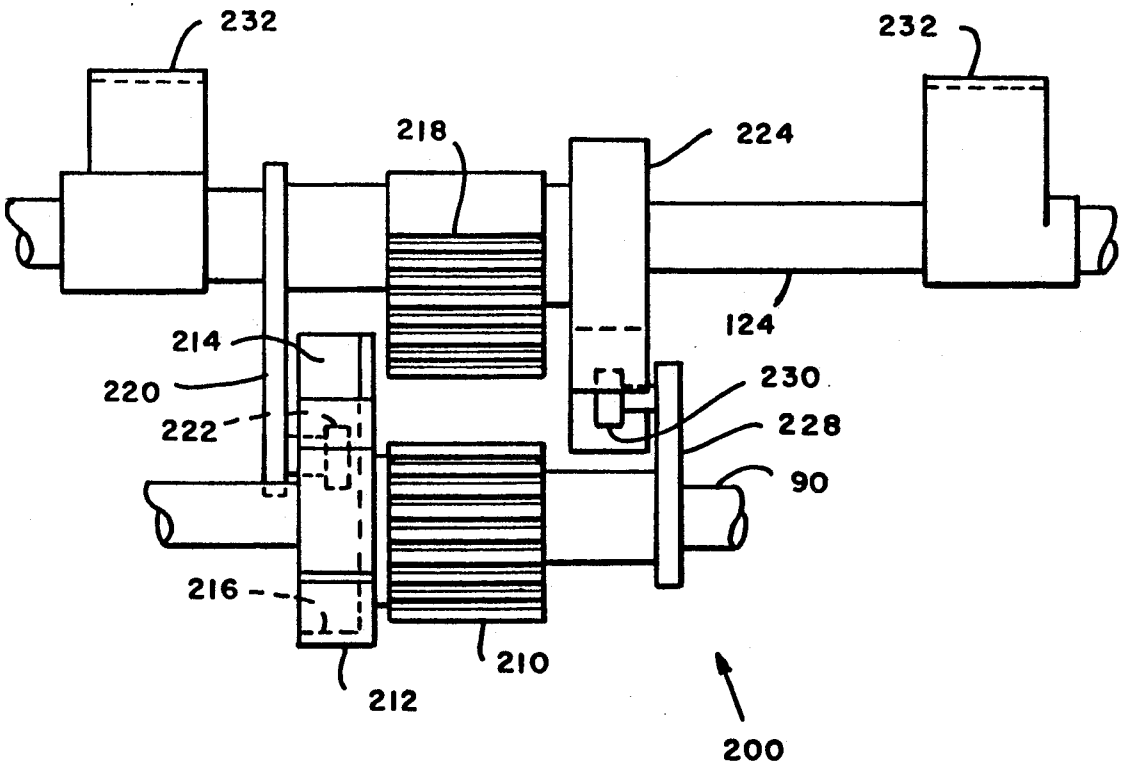
FIG. 6 is a top sectional view of the intermediate gear drive in accordance with the present invention.
Figure 7:
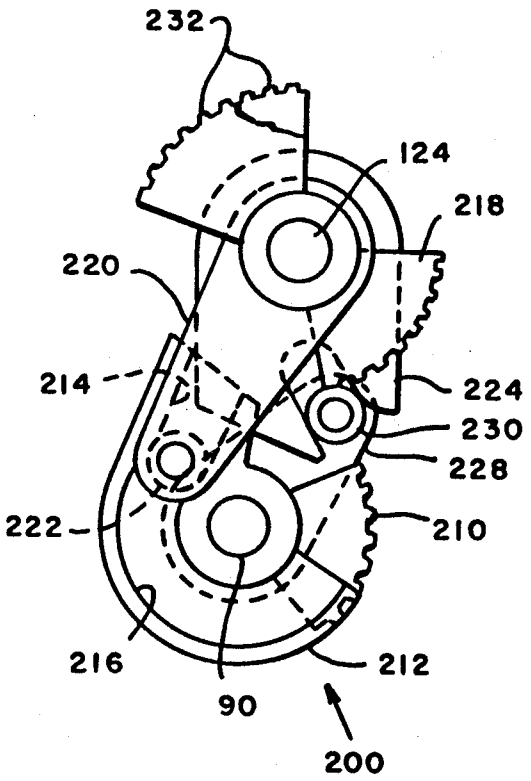
FIG. 7 is a side section view of a portion of the intermediate gear drive in accordance with the present invention.

Referring now to the present invention as illustrated in FIGS. 3–7., the invention employs an intermediate drive assembly 200 to replace the drive 42 and gears 123 (refer to FIGS. 1 and 3 . The intermediate drive assembly 200 is comprised of a sector gear 210 fixably counted axially approximately midway along cam shaft 90. To the right side of the sector gear 210, as viewed in FIG. 5, is a Geneva-type engaging cam 212 having a contiguous first and second cam surface 214 and 216, respectively. Fixably mounted axially approximately midway along the shaft 124 is a second sector gear 218 along for cooperative engagement with the sector gear 210. To the right of the sector gear 218 fixably mounted around the shaft 124 is a lever 220 having a follower pin 222 aligned to be received in the cam surfaces 214 and 216. Fixably mounted to the left-hand side of the sector gear 218 as viewed in FIG. 5, is a second Geneva-type engaging cam 224 having a cam seat 226. Fixably mounted to the left-hand side of the sector gear 210 on cam shaft 90 is a second lever 228 having a follower pin 230 aligned to be received in the cam seat 226. Also mounted on the shaft 124 respective in place of gears 126 is a respective sector gear 232.

It is noted that the prior art system as represented in U.S. Pat. No. 4,945,831 used one motor for driving the inking cam shaft and another motor to drive the platen actuator to complete the print cycle. In order to drive the inker cam shaft approximately 240 degrees of rotation was required to complete the inking portion of the printing cycle. As a result, in the present invention, approximately 100 degrees of rotation of the cam shaft motion remains for actuation of the platen actuation through the gears 232. It is noted that approximately 2.0 inches of vertical upward motion is necessary to drive the mail against the inked indicia 38. During the inking operation, the drive 200 must dwell to prevent collision between the ink tray and the platen actuated mail piece (not shown).

Figure 8A:
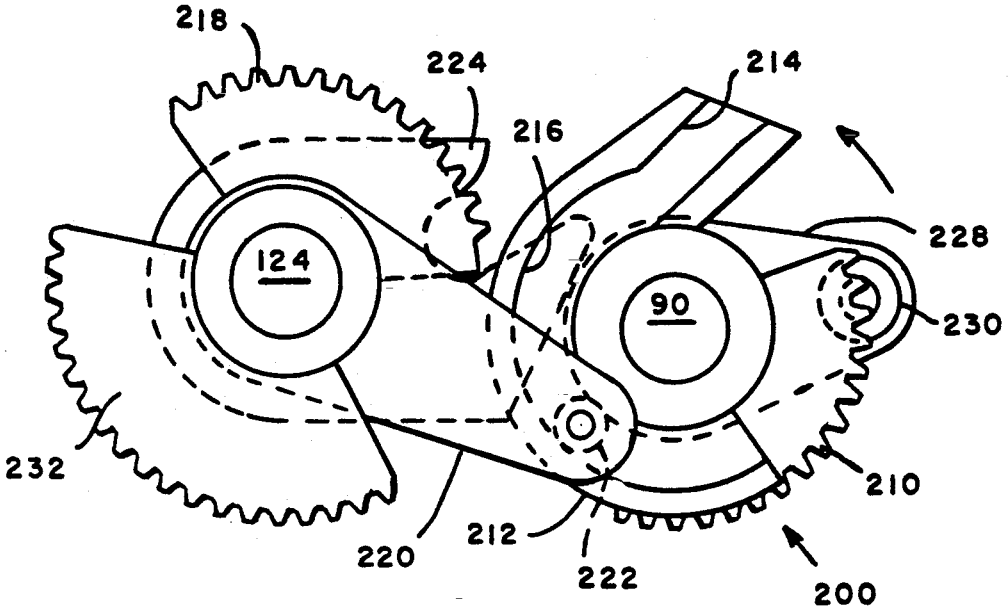
FIGS. 8A through 8G are sectional side views of the intermediate gear drive at progressive stages in accordance with the present invention.
Figure 8B:
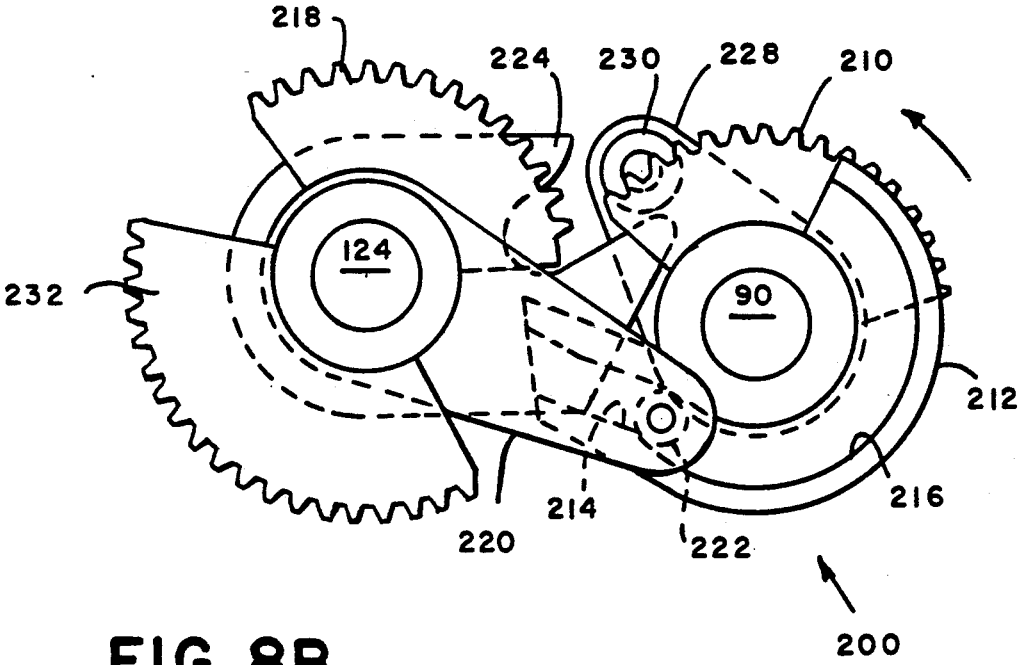
Figure 8C:
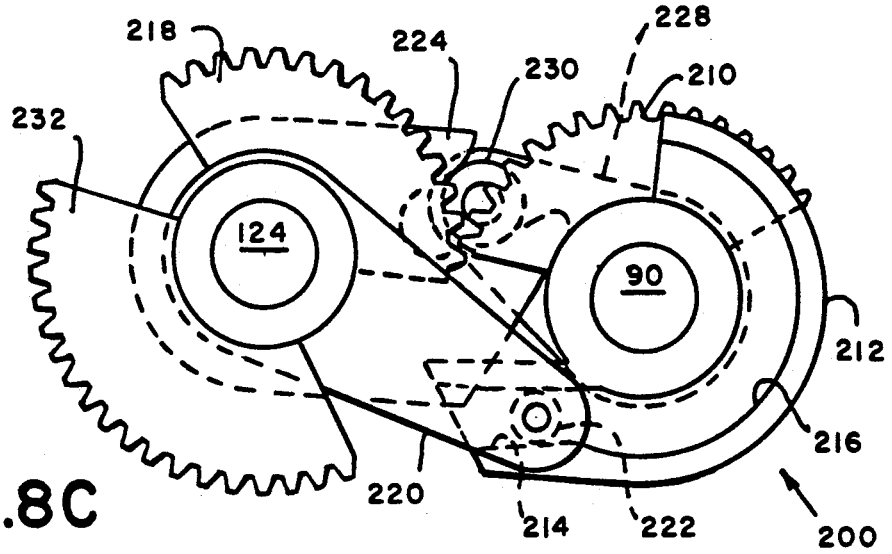
Figure 8D:
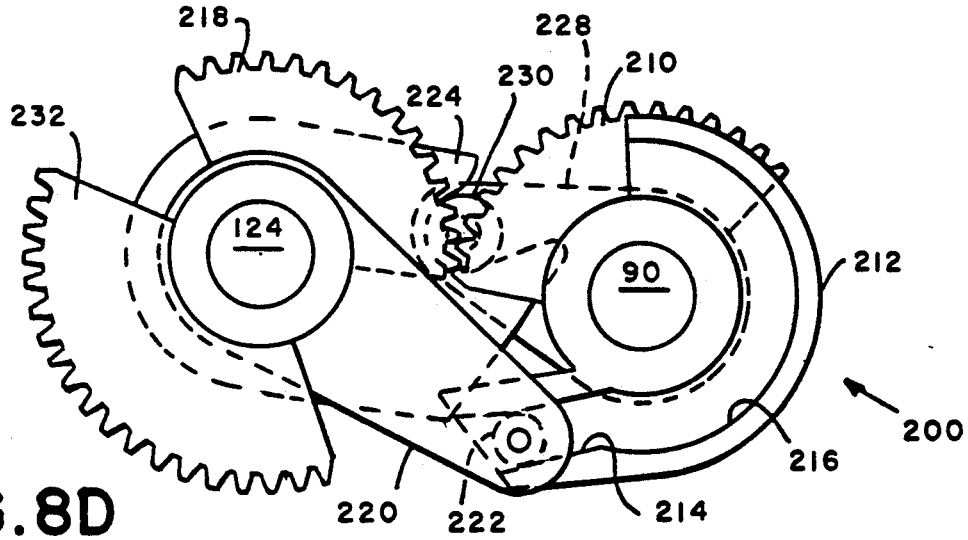
Figure 8E:
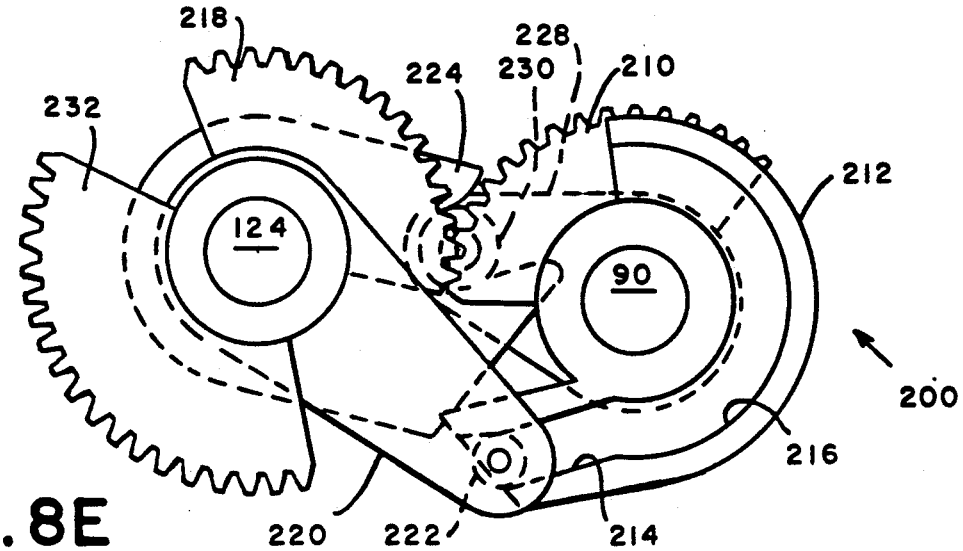
Figure 8F:
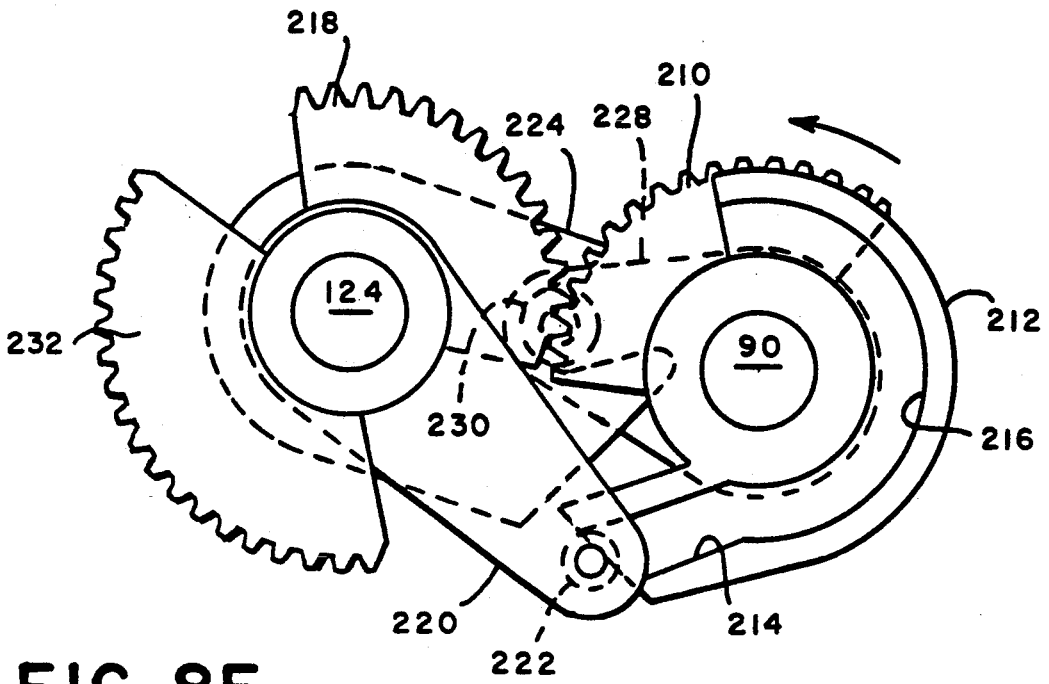
Figure 8G:
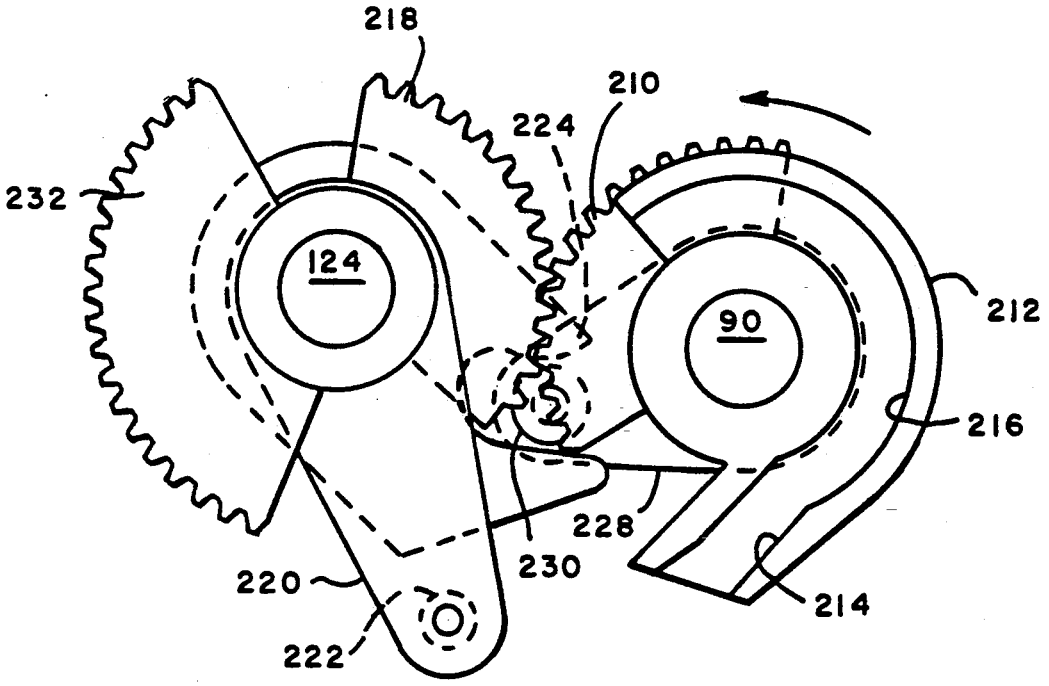

The intermediate drive system operation will now be described in terms of FIGS. 8A through 8G. It should be appreciated that the operation of the inking system and platen actuation remains as described in U.S. Pat. No. 4,945,831 with only slight variation in system timing. Referring to FIG. 8A, during the inking portion of the print cycle, the gears 218 and 210 are disengaged. Also, the follower pin 222 rides in the cam 216 producing no rotation of the shaft 124. Referring to FIG. 8B, as the inking cycle is being completed i.e., approximately 200 degrees of rotation of cam shaft 90), the cam follower 222 is initiating travel into cam surface 214. The contour of cam surface 214 causes the shaft 124 to rotate and brings the pin 230 into cam 226. As the pin 230 starts to seat in the cam 226, the follower 222 is traveling out of cam surface 214 and the gears 210 and 218 are being synchronously positioned for meshed engagement (FIG. 8C).

The remaining Figures, FIGS. 8D through 8G, illustrate the progression of the intermittent gear system 200 as the print cycle is completed. It should be appreciated that the action of motor 85 reverses its drive after printing has occurred, thereby reversing the progression of the intermediate gear system 200. It should further be appreciated that the links 105 are experiencing a dwell in cams 130 and links 71 are experiencing a dwell on cam surfaces 114 during the platen actuation and motor reverse drive.

Figure 9A:
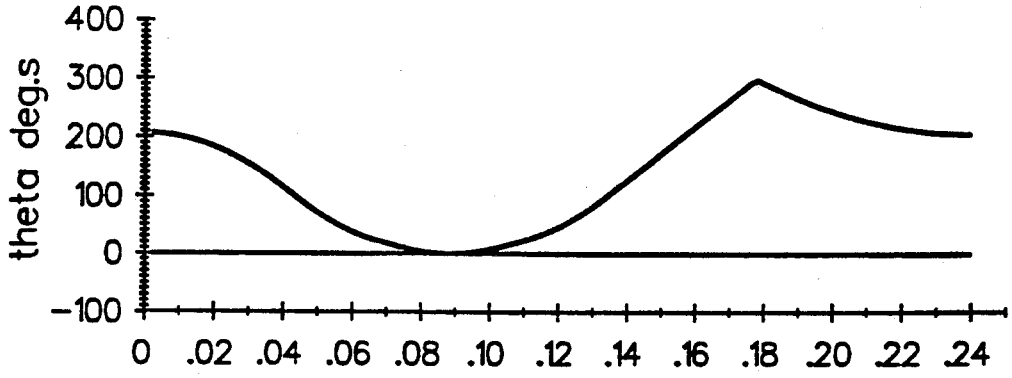
FIGS. 9A through 9C are plots of the cam shafts rotation at progressive stages relative to cycle time in accordance with the present invention.
Figure 9B:
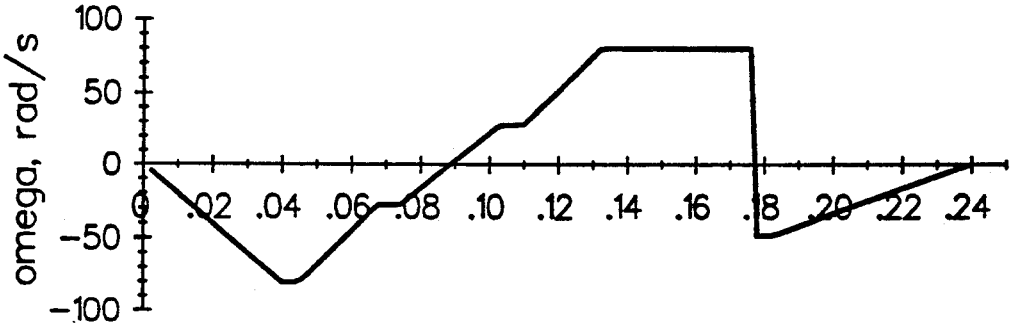
Figure 9C:
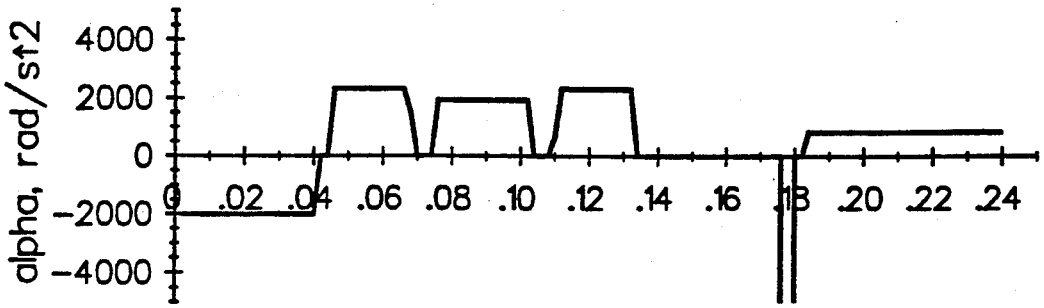
Figure 9D:
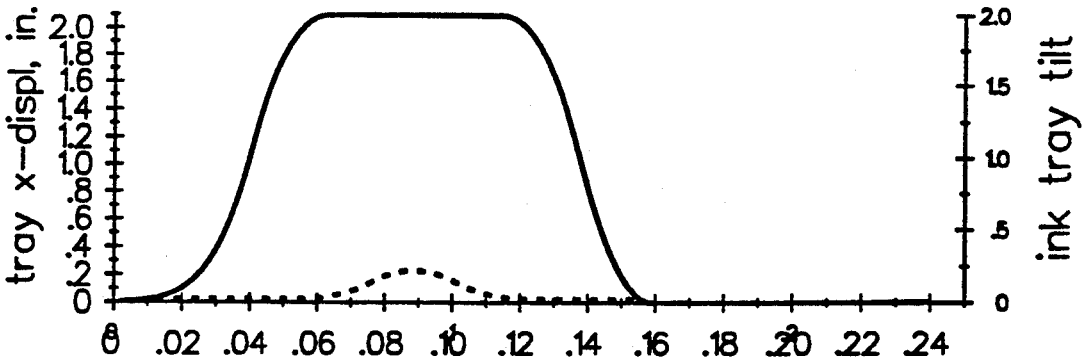
Figure 9E:
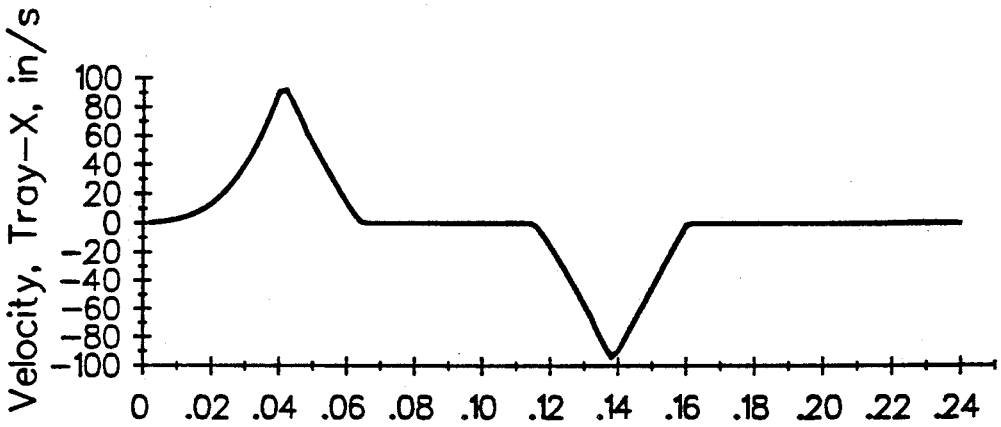
Figure 9F:
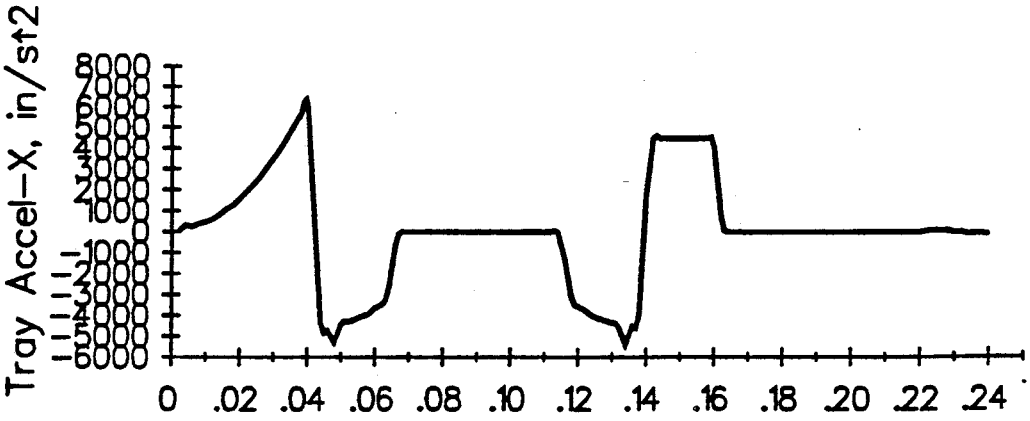
Figure 10A:
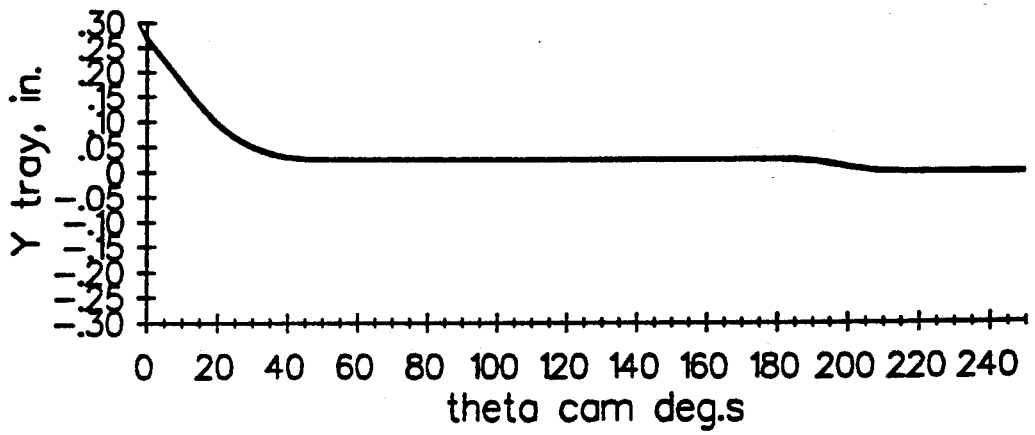
Figure 10B:
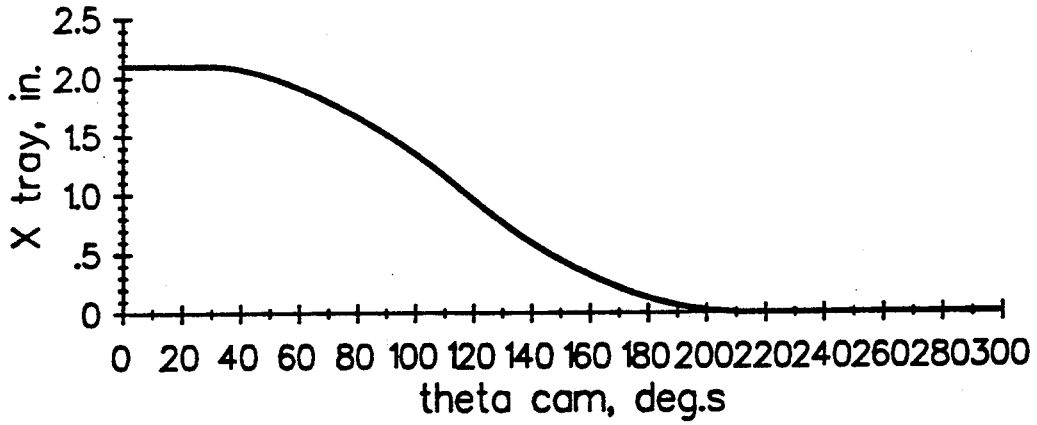

The relationship and cam shaft 90 rotation as a function of time is given in FIGS. 8A–8J. FIGS. 9D–9F show horizontal ink tray movement versus time; FIGS. 9G–9I shows vertical ink tray movement versus time. The plots in FIGS. 10*a* and 10*b* illustrate the ink tray vertical and horizontal position as a function of the cam 88 rotational angles. The cam profiles are configured to ensure that there is a bounceless strike of ink pad 36 against printing device 38, i.e., once ink pad 56 has been tamped against printing device 38 and it starts its downward movement, it is prevented from restriking printing device 38. The cam profiles are further configured to provide smooth acceleration and deceleration.

Figure 11A:
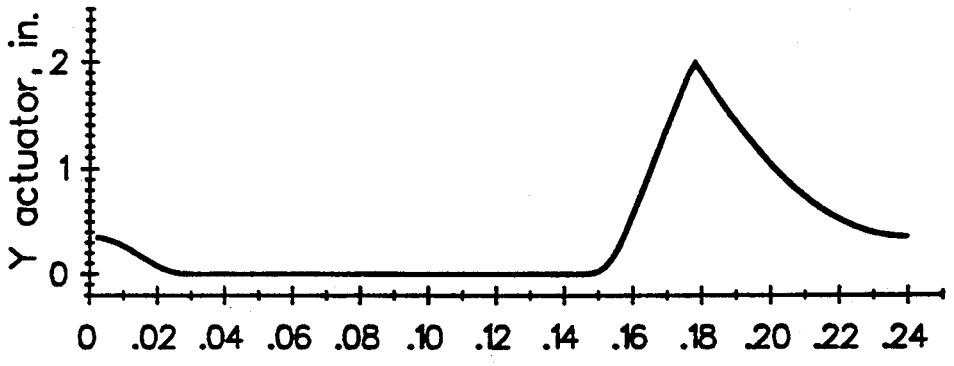
FIGS. 11A through 11C are plots of the plateau respective vertical position, velocity and acceleration as a function of time.
Figure 11B:
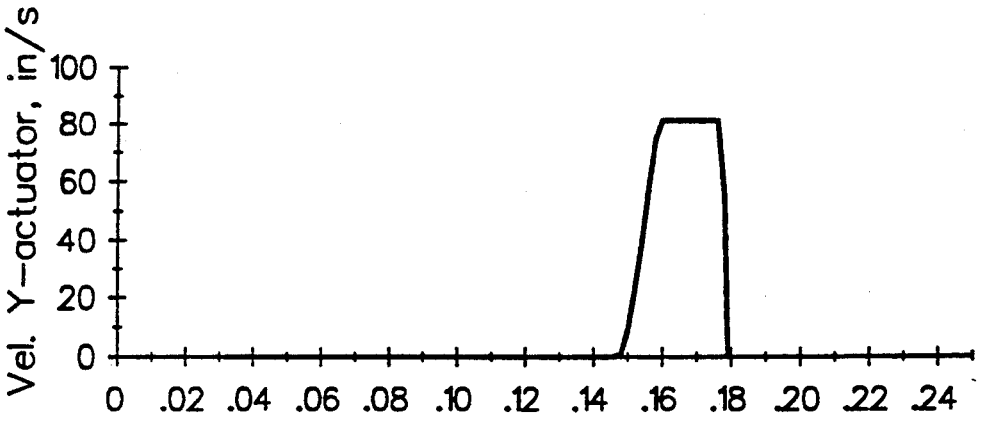
Figure 11C:
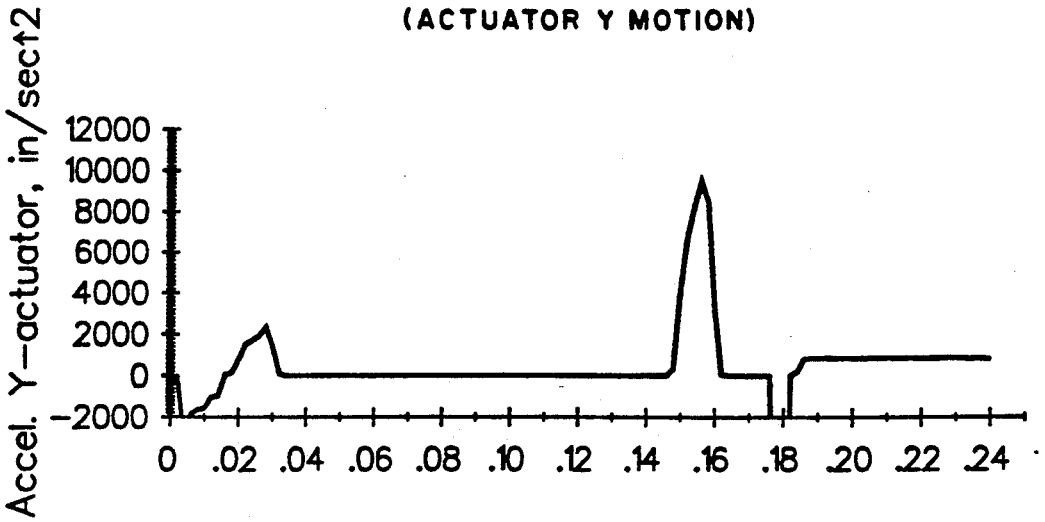
Figure 12:
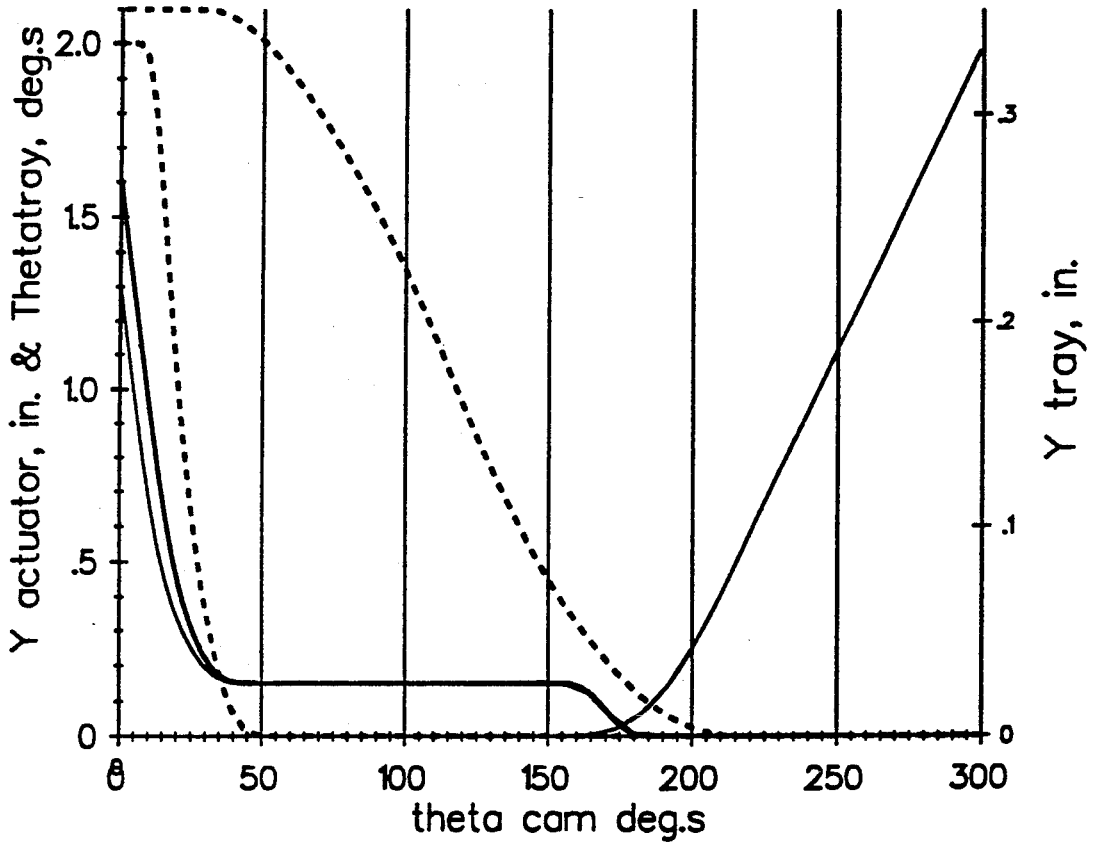
FIG. 12 is a plot of the kinematic energy developed by the plane in accordance with the present invention.

FIGS. 11A–11C show the vertical positioning of the actuator 44 as a function of time and FIG. 12 show the kinematic energy profile of the actuator 38 as a function of theta cam angle, theta representing the cam shaft position which references the cam position relative to the chosen ground.

Certain changes and modifications of the embodiments of the invention herein disclosed will be readily apparent to those of skill in the art. Moreover, uses of the invention other than in mailing apparatus will also be readily apparent to those of skill in the art. It is the applicants' intention to cover by the claims all such uses and all those changes and modifications which could be made to the embodiments of the invention herein chosen for the purposes of disclosure which do not depart from the spirit and scope of the invention.

What is claimed is:

1. An improved drive system for a flat bed printing apparatus which includes a print cartridge having a print plate mounted in the base of said printing apparatus, an inking system for inking said print plate having a drive motor mounted in said base in driving communication with a first shaft rotatively mounted in said base, a cam mounted to said first shaft having cam surfaces, an ink tray positionable by a linkage system wherein said linkage system includes cam followers in communication with said cam surfaces to position said ink tray in response to said rotational position of said cam, and a platen reciprocally positionable between a first and print position, wherein the improvement comprises:

a first means for positioning said platen between said first and print position;

said cam having a first range of rotation wherein said cam surface positions said linkage system, to effect displacement of said ink tray to ink said print plate and having a second range of rotation wherein said linkage system is in a dwell mode; and, second means for communicating said rotation of said first shaft to said first means only when said cam is rotated in said second range.

2. An improved drive system as claimed in claim 1 wherein said second means comprises:

a first sector gear fixably mounted to said first shaft;

said first means for positioning said platen between said first and print position having a second shaft rotatively mounted in said base;

a second sector gear fixably mounted to said second shaft; and, third means for synchronously engaging said first and second sector gears only when said cam is rotated in said second range.

3. An improved drive system as claimed in claim 2 wherein said third means comprises:

a first cam being fixably mounted to said first shaft having a cam surface;

a first cam follower fixably mounted to said second shaft, said first cam follower being confined to said first cam surface when said cam is in said first range, wherein said cam surface places said first cam follower in dwell;

a second cam follower fixably mounted to said first shaft; and, a second cam fixably mounted to said second shaft having a seating cam surface, wherein said second cam follower is seated in said seating cam surface when said cam is in said second range, wherein said second cam is rotated in said second range, said second cam causing said second shaft to rotate.

4. An improved drive system for a postage meter mailing machine utilizing flat bed printing which includes a postage meter cartridge having an indicia plate mounted in the base of said printing apparatus, an inking system for inking said indicia plate having a drive motor mounted in said base in driving communication with a first shaft rotatively mounted in said base, a cam mounted to said first shaft having cam surfaces, an ink tray positionable by a linkage system wherein said linkage system includes cam followers in communication with said cam surface to position said ink tray in response to said rotational position of said cam, and a platen reciprocally positionable between a first and print position, wherein the improvement comprises:

a first means for positioning said platen between said first and print position;

said cam having a first range of rotation wherein said cam surface positions said linkage system effect displacement of said ink tray to ink said print plate and having a second range of rotation wherein said linkage system is in a dwell mode;

second means for communicating said rotation of said first shaft to said first means only when said cam is rotated in said second range, said second means including, a first sector gear fixably mounted to said first shaft, said first means for positioning said platen between said first and print position having a second shaft rotatively mounted in said base, a second sector gear fixably mounted to said second shaft, third means for synchronously engaging said first and second sector gears only when said cam is rotated in second range; and, said third means including a first cam being fixably mounted to said first shaft having a cam surface, a first cam follower fixably mounted to said second shaft, said first cam follower being confined to said first cam surface when said cam is in said first range, wherein said cam surface places said first cam follower in dwell, a second cam follower fixably mounted to said first shaft, a second cam fixably mounted to said second shaft having a seating cam surface, wherein said second cam follower is seated in said seating cam surface when said cam is in said second range, wherein said second cam is rotated in said second range, said second cam causing said second shaft to rotate.

* * * * *